US008220497B1

(12) United States Patent
Guarascio

(10) Patent No.: US 8,220,497 B1
(45) Date of Patent: Jul. 17, 2012

(54) PLUMBING TRAP PROTECTIVE DEVICES AND METHODS

(76) Inventor: Daniel Guarascio, Naples, FL (US)

( * ) Notice: Subject to any disclaimer, the term of this patent is extended or adjusted under 35 U.S.C. 154(b) by 162 days.

(21) Appl. No.: 12/653,595

(22) Filed: Dec. 16, 2009

Related U.S. Application Data

(60) Provisional application No. 61/281,072, filed on Nov. 12, 2009.

(51) Int. Cl.
*F16L 55/10* (2006.01)

(52) U.S. Cl. ..... 138/89; 138/97; 137/68.11

(58) Field of Classification Search ..... 138/89, 138/90, 97; 137/68.11
See application file for complete search history.

(56) References Cited

U.S. PATENT DOCUMENTS 5,385,688 A * 1/1995 Miller et al. ..... 252/73
7,081,175 B2 * 7/2006 Serizawa et al. ..... 149/46
7,328,475 B2 * 2/2008 Smith et al. ..... 15/104.061

* cited by examiner

*Primary Examiner* — Patrick F Brinson
(74) *Attorney, Agent, or Firm* — Doonan Dwight McGraw

(57) ABSTRACT

A combination in a mixture, solution, emulsion, or other ways of combining the different elements that make up the combination, to prevent odors in sewer lines from entering various types buildings, trailers, motor homes, manufactured homes, and the like which have plumbing fixtures therein with a connection to be made to a sewer line to conduct refuse from the plumbing fixture or fixtures to the sewer line. Sewer lines are breeding grounds and conduits for odors, and unprotected plumbing fixtures connected to sewer lines can be the entry points of such odors, particularly when the fixtures are left idle for many weeks or even months. The different elements forming the combination are water and polyethylene glycol (PEG) or a similar member of the glycol family, such as polypropylene glycol (PPG), propylene glycol (PG), and ethylene glycol (EG). It may also include, when appropriate, one or more odor-control and/or other control substances. A particular volume ratio of the glycol and the water may be used to take advantage of the hygroscopic characteristic of the glycol and the evaporation from the water component so that the volume of the liquid blocking device will remain substantially constant for those long periods of time.

35 Claims, 2 Drawing Sheets

Figure 1:
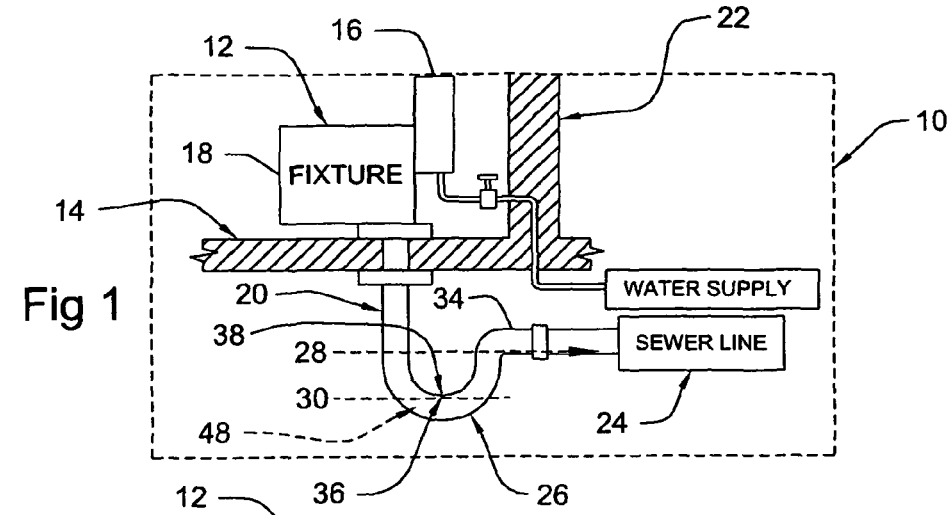

Shows changes in volume of different percentages of mixture of PEG and $H_2O$ over long periods of time and temperature changes.

PLUMBING TRAP PROTECTIVE DEVICES AND METHODS

CLAIM OF PRIORITY

Priority is claimed based on the disclosures in Provisional Patent Application Ser. No. 61/281,072, filed Nov. 12, 2009, by inventor Daniel Guarascio, who is the inventor of the invention herein disclosed and claimed. The title of that application is "Devices and Methods of Preventing Sewer Odors From Entering Buildings via Plumbing Fixtures While They Are Closed for Extended Periods of Time, and Concurrently Acting to Prevent Freezing of Plumbing Traps."

FIELD OF THE INVENTION

Blocking the entry of obnoxious invasive matters, and particularly various noxious odors, from a sewer pipe system into plumbing fixtures through each fixture's S-type plumbing trap and on into the building in which those fixtures are installed to the detriment of the building when the building is to be closed, and the plumbing fixtures' being unused for extended periods of time. This also applies to P-traps, which are typically floor trap that have liquids, and at times some solids, swept or spilled or otherwise being on a floor. These P-traps are found in the floors of shower stalls as well as kitchens, wash areas for vehicles in vehicle car washes, etc. They are often in recesses in the floor of an area and have gratings over the recesses to allow persons to walk over that part of the floor. The descriptions of use in an S-shaped trap therefore also apply to P-traps, which, instead of being connected to a plumbing fixture, are connected directly to a more open space in a structure such as a shower. Each blocking device includes a combination of materials. By far, all or almost all of the blocking device is in liquid form. It is, therefore, easily placed in the fixture plumbing traps. There is provision for introducing relatively small amounts (by volume) of certain control items into the blocking device liquid to control such things as noxious odors, as well as control items for minimizing the entry of insects and/or vermin, which are small animals such as mice and rats and other feral animals that may be in the area where the blocking devices are to be used. Such items are not always liquid, and even when they are, they commonly have relatively small volumes, and do not either receive water from the ambient atmosphere or have water evaporating from them so as to have changes that affect the total volume of the entire blocking device.

In accordance with the invention, other materials may or may not also be incorporated into the liquid blocking device. These materials may be of several types, with the broadest type being odor controls. One or more of these odor controls may be used. Another of the types that may or may not be used is materials that control or deter the entry into the fixture via the plumbing trap of insects such as ants and roaches and vermin, such as rats and mice, and even frogs and snakes. Usually one of the liquid materials is an antifreeze, so that it serves blocking purposes as well. The types are described in detail below under the section of this document entitled, "Detailed Description of the Invention and the Drawing Illustrating the Invention in Use." Also, the major aspect of the invention provides for keeping the required two liquid materials, usually a glycol and water, at the same total volume within each plumbing trap for the long periods of time that the liquid blocking device is to be installed and operative. As a related aspect, the invention can use only one liquid with one or more controls for odor, insects, and/or vermin, some of which will have some water in them. While this modification of the invention can be used in any climate, it is most applicable in the areas where the climate involves extremely cold weather when it is advisable to use very little, and at times even no, water other than what is in a control.

DESCRIPTION OF THE RELATED ART

There are several notations in the readily available published materials provided by manufacturers and sellers of polyethylene glycol (PEG), polypropylene glycol (PPG), propylene glycol (PG) and ethylene glycol (EG), as well as some other glycols that are being used in camping trailers, boats, mobile homes, motor homes, and such to keep the pipes from freezing. Since most of such glycols are commonly sold either as 100% glycol or as a 50% mixture of water and glycol in equal volumetric strength amounts, those percentages are at least starters. However, manufacturers and sellers usually supply various glycols in liquid form at either 100% strength (sometimes saying 99.9%, to allow for some possible but minor impurity) or at 50% strength, measured by volume, with the other 50% being water because their customers are satisfied with these two options. Apparently, for the uses in liquid form that those customers know about, these two volumetrically measured strengths are sufficient. Of course, the ultimate users of these as an antifreeze may still apply water to the 100% glycol, or to the 50% water-50% glycol mix, to lower their costs. For extremely cold areas where lower the winter ambient temperatures are −25° F. to −70° F., only the 100% glycol should be used. The added controls may have some water in them, however.

It has also been recognized for many years that the above-recommended glycols are much safer than the traditional EG antifreeze (or TEG) because, among other reasons, they are not dangerous if there is a leak, and some of the leakage is consumed by animals. Commonly used antifreeze uses EG, and it is often fatal to animals. This commonly occurs when domestic animals, such as pet or lost or feral dogs and cats, and other feral animals, such as wolves, foxes, racoons, o'possums, or rats, lick some of that antifreeze up where it has been spilled, leaked, or overflowed, from automobiles, trucks, and farming equipment, in particular. It has a sweet taste that attracts those animals. It could be similarly fatal to animal and insect pests when used as a major part of the blocking device, which may be desirable, but the risk of its killing animals that are preferably not killed is high, and therefore the use of EG is still within the purview of the invention to the extent that it could be used, even though it is not the most preferred glycol to use.

There are many published usages of PPG and/or similar glycols, such as PG and PEG, that show up on the Internet. In addition to being used as antifreeze, variations of glycols are used as medicine or in some liquids because of their properties other than purely medical, such as being considerably more slippery than plain water. They are also being used in food preparations and cosmetics of numerous types, but nothing showing that they are used in a certain proportion for reasons other than cost when acting in plumbing traps so that they block the passage through the trap for long periods of time expressed in weeks and months. Neither was any information found where antifreeze, and particular glycol antifreezes, were provided with certain controls that control sewer odors and/or the presence of ants, roaches, and other similar insects, or vermin that range from the more usual rats and mice to reptilians, such as frogs, various types of lizards and similar animals, and even, upon occasion, snakes.

Some information published by suppliers of various glycols includes a table of temperatures at which a particular mix of certain glycols and water would freeze. The impression given for providing this information, based on the lack of other reasons, is that of economy and/or the relative ease of mixing glycol and water by the supplier rather than the purchaser. Glycols are more expensive than water, and the less percentage of the mix being a glycol, the less expensive would the mix be to the purchaser. Many suppliers have professional-grade mixers that yield better mixing than the purchaser usually has, with less labor and cleaning up afterward.

No information was found about any particular percentages of the glycol-to-water ratio having any relationship to the length of time that a glycol-and-water device, being used as an antifreeze, would likely remain in an absolute blocking mode in a plumbing trap. Nothing was found recognizing or suggesting the importance of the relationship of the water evaporation to the absorption of water by the glycol, nor, more particularly, about its having a meaningful bearing on the change in volume of the mixture over long periods of time.

No information was found that anyone has considered the change in volume of the mixture of the glycol and water, used to block passage through a pipe over a period of time, as being as important a problem as it is when a liquid blocking device is used, and therefore a solution to that problem has not been previously recognized. This is very different from the attitude that, if we do not know that there is a problem, then we have no reason to change anything. The inventor thinks that it should have been recognized and applied long ago, but it has apparently not been recognized.

Neither was there found any information that indicated the desirability of inclusion of one or more odor control materials to be a part of the blocking device or mechanism to assure that most, even if not all, of the sewer odors do not pass through plumbing traps and into the building or other structure that has plumbing fixtures with plumbing traps connected to both the fixtures and the sewer system.

Nor was there found any information that indicated the desirability of including any readily available insect deterrent or killer, or small animal detterent or killer, by way of example and not limitation, to prevent such insects and/or small animals from entering the fixture, and then on into the building, through the plumbing traps that are connected to sewer lines. None seemed to recognize a problem with even some reptilians, such as frogs, can actually exist, breed, hatch, and live in sewers and at times have been known to enter fixtures or floor areas to which either S-traps or P-traps are connected. The inventor, a experienced and professional plumber, has been faced with a situation where frogs were entering a toilet and apparently breeding and hatching into tadpoles which became frogs. The occupant tried to eliminate them with antifreeze or some similar item that killed the frogs, but left their bodies in the trap to the extent that the trap was blocked from usage because no water could be flushed or poured into and through the trap. By the use of the invention, even in its broadest form, this could have been totally prevented, with much less stress on the lady who owned the house in which this occurred.

BRIEF SUMMARY OF THE INVENTION

A device embodying the invention includes a blocking arrangement that both physically and, by use of one or more odor controls or odor eliminators as part of the arrangement, entry of sewer odors into a building is successfully prevented, usually even if the physically blocking part of the device is decreased for any reason so that there is a connective passage from the sewer system to the plumbing fixture. The blocking arrangement may also have one or more insect controls and/or vermin controls, which at least help prevent insects and vermin from entering the building through the plumbing trap and its fixture. The blocking arrangement is placed in the lowest part of the plumbing trap that receives fluids and various other matters from the fixture, and it is expected to block the connection between the fixture and the sewer system so that no air connection exists. It also usually fills up most, if not all, of the U-shaped outlet. Once an air connection does exist, the noxious odors, and at times even insects and vermin, may enter the fixture from the sewer system. That is very undesirable.

A very important aspect of the invention includes a volume control method which, when carefully applied, will maintain the actual volume of the blocking device or arrangement substantially constant for the duration of the usage of that device or arrangement while the building, or at least the fixture in which it is installed, is not used for long periods of time commonly measured in weeks and even in months. While it is not absolutely necessary to include this feature in the practice of the invention when some other noted feature or features involving odor and/or pest control are used, it is highly desirable unless, irrespective of its advantages, a user of the invention desires, for any reason, to use a greater volume of glycol than the method of maintaining a constant volume of the liquid blocking device requires. There are climate occasions where it is more important to keep the liquid blocking device from freezing than to either partially or totally control the volume. Then, the basic liquid is only that of a glycol antifreeze, with little, or even no, water being a part of the liquid blocking device. It is recognized that even so, the glycol will absorb water from the ambient atmosphere, and thus will, over time, add some water to the liquid glycol that can become a substantial amount of the total volume of the liquid blocking device.

Further Description of the Blocking Device and Some Materials that are Placed in it When the Result of the Use of Such Materials is Desired.

In one preferred embodiment, the blocking device material is composed primarily of one of the glycol family members comprising polypropylene glycol (PPG), polyethylene glycol (PEG) and propylene glycol (PG). These glycol family members also include ethylene glycol (EG) and triethylene glycol (TEG), but on a less desirable basis, based on their being very toxic, and poisonous, as is pointed out here. The term G may be used herein to include any or all of these workable glycol family members unless otherwise specifically specified. Therefore, the term G does not exclude EG or triethylene glycol (TEG) in this document, but, as earlier noted, because of the toxicity of those particular glycols, when either one is consumed by animals, such as dogs and cats, as well as animals who are wild but live in areas where antifreeze may be on the driveway or road beneath a vehicle that has leaked some EG or TEG, are not very desirable glycols to use. Yet, there may be times when one of them is going to be used, and when that occurs, the practice of the invention also applies to the use of either of these two glycols, and they must always be handled and use with great care.

The G is used in a liquid form, and is preferably mixed with water at a desired ratio to the G as needed. More about that later. The particular blocking devices or materials preferably have one of the glycols that are preferably members of a glycol family, and that family includes polypropylene glycol (PPG), polyethylene glycol (PEG) and propylene glycol (PG). Usually, only the one initialized name G may be used, and, when so used, generally shall be considered to alternatively include one of these other named members of the glycol family as well as some variations thereof which have similar features and values as do those named glycols.

EG is a simple member of the glycol family, but is not very desirable as a part of the blocking device because of its toxicity to animals. However, that does not relieve some potential infringer of any claim based on the disclosure in this application by using EG (or TEG) instead a different G glycol. A possible infringer can sometimes include or use one or more definitely undesirable components either through lack of information or in an attempt to avoid infringement of any such claim. For that purpose, the term G does include EG and TEG, but it is just undesirable to do so for the reasons set forth above. Yet, only for practical but emergency reasons, EG could be used on a temporary emergency basis if it is the only glycol available for a short time. It should be replaced when a safer glycol is available because of its toxicity. Incidentally, TEG is a version of EG and it is classed as toxic, as is EG, yet it has many uses based on its high hygroscopic properties. For that reason, it is considered to be in the glycol family that may be used in practicing the invention herein disclosed and claimed. It is currently used as dehumidifiers in air conditioning systems and, when volatilized, as an air disinfectant for bacteria and virus control. Glycols, such as TEG, having high boiling points and a strong affinity for water, are also used to remove water vapor from natural gas.

Now, with more regard to the desired ratio of the mixture of G and water. The chosen ratio depends to some extent on the lowest and highest temperatures that the G is likely to be exposed to while being used as a blocking material in plumbing traps, and the ability of any mixture thereof to contain, hold, and yet allow some odor treatment or odor-eliminating material or materials to be received therein and to function as an odor control. Two of the characteristics of a mixture of a defined amount of G and a desired amount of water are particularly important. These characteristics are the combination of evaporation of the water of the mixture over time and the hygroscopic absorption of water in the atmosphere by the G of the mixture over time. The following analysis directly applies to the use of polyethylene glycol (PEG), which was used in that analysis. It also directly applies to the use of the other listed glycols that have substantially the same rates of hygroscopic action that polypropylene glycol has, other than ethylene glycol and triethylene glycol. The hygroscopic actions of these two glycols are at higher rates than those others, and therefore would result in somewhat different relative rates of absorption of water which would change the percentage volume of the glycol to a somewhat smaller percentage and the water to a somewhat larger percentage. However, the principle, discovered and applied by the inventor while using polyethylene glycol and water, still applies. There was not found to be any prior knowledge, and more certainly, no recognition of the principle of balancing the amount, by volume, of water absorbed by a glycol over any period of time and the amount, also by volume, of water evaporated from the water component of the liquid blocking device over the same period of time. Since the periods of time for absorption and for evaporation must always be equal, such time does not further enter into the method.

Figure 5:
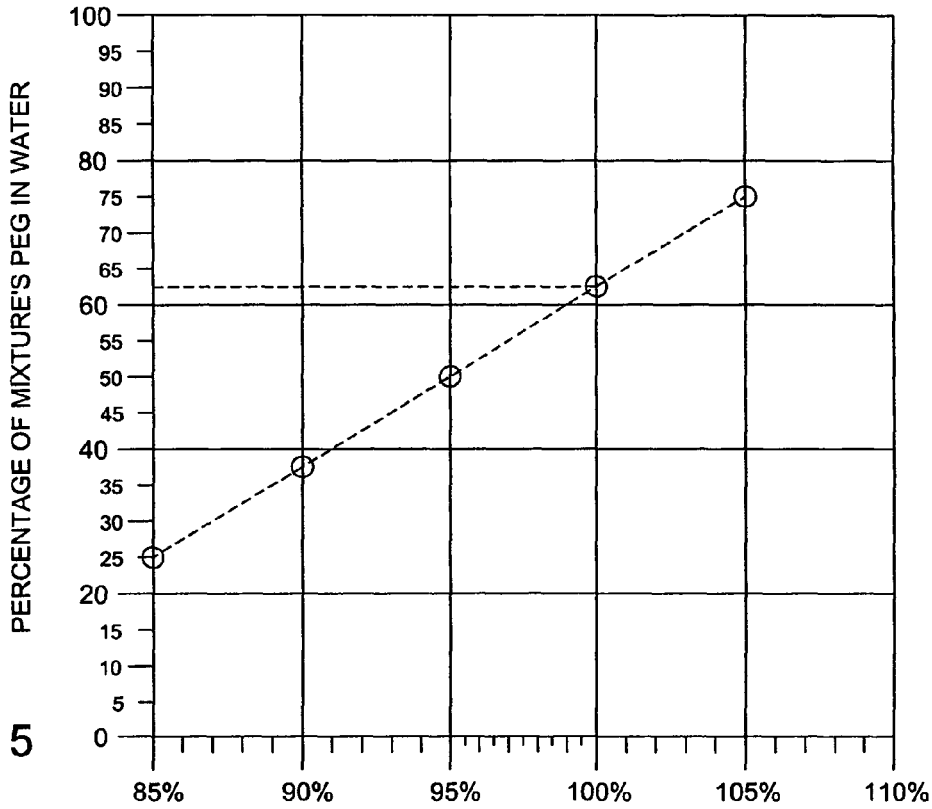

As a body of water evaporates over time, the remaining body of water becomes less in volume quantity. Because water is in the atmosphere as moisture and is contacting the G at its level in each of the inverted and upright U legs, it is absorbed by the G because the G is hygroscopic and thus takes up and retains such moisture as liquid water. That tends to increase the amount of water in the mixture, and therefore the volume of the mixture. Thus, it is strongly preferred that the loss of a volume of water out of the mixture of G and water due to evaporation of the water component be counteracted by the absorption of the same quantitative volume of water by the "G." This cooperative set of characteristics with regard to the removal and replacement of water in the mixture of G and water is very desirable. When the quantity, by volume, of the mixture is substantially maintained at a constant level, there is no atmospheric pass through the lower U of the plumbing trap. This is very important because then the mixture that is the blocking device always has a part of the plumbing trap so filled with the mixture that no odors can pass from the sewer pipe into the fixture to which the plumbing trap is attached, even as the water is evaporating but is being replaced by the hygroscopic action of the "G." This is further discussed below when discussing the drawing, and is illustrated in FIG. 5 of the drawing.

Even if the physical blockage is breeched due to excess water evaporation or some leakage, the odor treatment or odor-eliminating materials will still be present, and will still tend to keep any sewer odors controlled or eliminated before they can pass back into the plumbing fixture or fixtures and thus into the building generally. Thus the invention in this respect combines both the known way of just physically blocking the trap with a fluid or combination of fluids, and the improvement, wherein the control of odors before they enter the fixture via the plumbing trap, by the elimination of the source of that odor is maintained so that no odor molecules enter the building through the trap, even over one or more extended monthly or seasonal periods. That also applies to features which, if and when they are used, prevent or at least discourage the entry into the fixture by insects and vermin. It also applies to the feature added by the invention by which the blocking device is maintained at a substantially constant total volume so that the blocking device is kept at a substantially constant level in the plumbing trap so that the blocking device or mechanism is always performing its purpose in that respect.

BRIEF DESCRIPTION OF THE FIGURES SHOWN IN THE DRAWING

Figure 2:
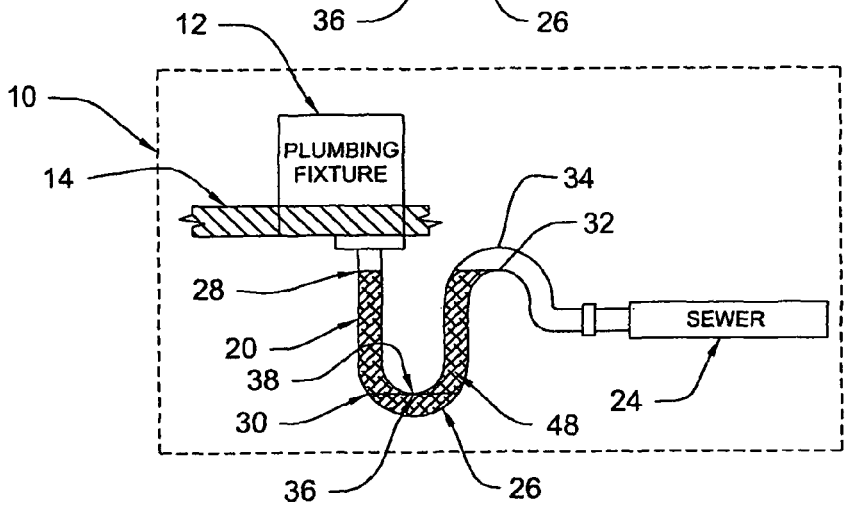

FIGS. 1 and 2 somewhat schematically show typical S-type plumbing traps for a toilet.

Figure 3:
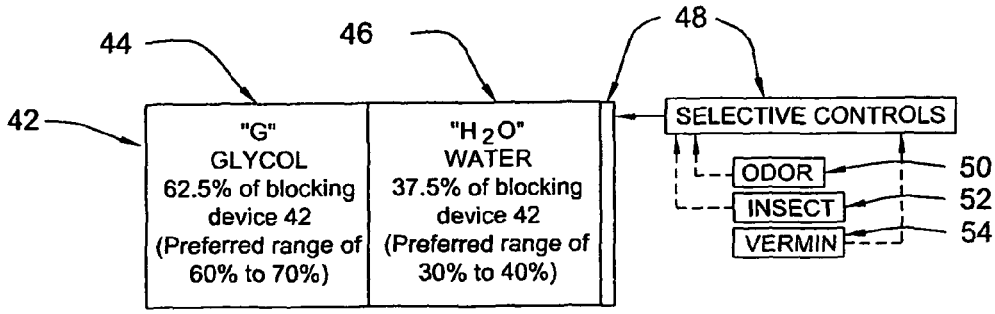

FIG. 3 is a block diagram showing the basic parts of the invention that are combinable to be one trap blocking device that is an example of the invention herein disclosed and claimed. For one broad aspect of the invention, only two basic parts are required, as are later described in detail. That broad aspect of the invention makes use of only glycol and water, each one having a volume which when added together is the volume of the trap blocking device; with the volume of the hygroscopic polyethylene glycol being 62.5% of the combined volume forming the blocking device, and the water being 37.5% of that combined volume. That water evaporates over time so that the water loses volume at a volumetric rate which is substantially equal to the volumetric gain of water by the hygroscopic glycol, which has the other percentage of the total blocking device volume. The use of other controls is also graphically shown in this FIGURE.

Figure 4:
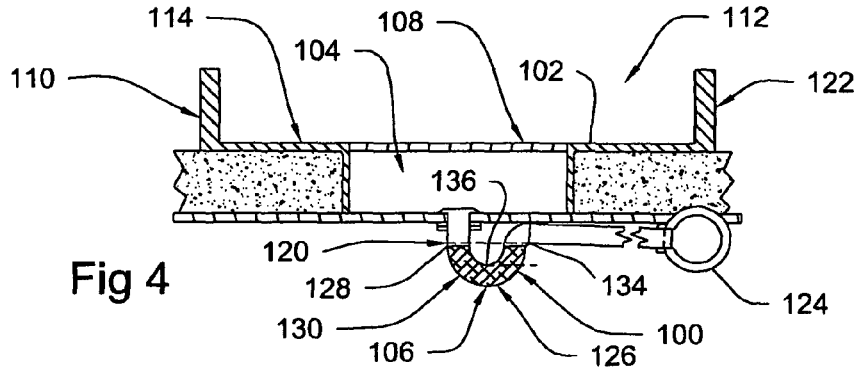

FIG. 4 somewhat schematically shows a typical P-type trap installed in a grill-covered recess in a floor.

FIG. 5 is a graph showing a range of volume percentages of the polyethylene glycol that are combined with the water to be 100% of the volume of that mixture, and the percentage change in the volume of that mixture due to the combination of the increase in the volume of the glycol because it is hygroscopic and attracts water moisture from the ambient atmosphere to which the mixture is exposed. The decrease in the volume of the water portion of the mixture due to its evaporation having taken place after a one month exposure of the mixture to the ambient atmosphere at the highest daily temperatures ranging from 80° F. to 95° F. at about three p.m. to the lowest daily temperatures ranging from 76° F. to 80° F. each night, in southern Florida, with the humidity ranging between about 60% and 95% over that monthly period. These temperatures and humidity ranges are common there, as well as many other parts of the northern hemisphere, during the months of April through October, which represents a typical period when many southern Florida houses and apartments are closed while the owners are at their northern homes.

DETAILED DESCRIPTION OF THE INVENTION AND THE DRAWING ILLUSTRATING THE INVENTION IN USE

In FIGS. 1 and 2 of the drawing, there is schematically illustrated a building 10 having therein at least one plumbing fixture 12, illustrated as being a toilet, or water closet, as it is known in some countries. It is supported by a substantially level surface such as a floor 14 of building 10, or at times is somewhat raised above the floor. When the fixture is a wash basin, for example, it is usually supported by a counter which is cut out to receive the wash basin. When the typical toilet is used, the plumbing connecting the toilet water tank 16 to the toilet main body 18 and the water trap 20 is commonly either below the building floor 14 or below the level of that building floor upper surface, and may be either in a high height of flooring or, at least to some extent, in the wall 22, particularly if that floor 14 and wall 22 are in an upper story of the building, with a vertical connection leading downwardly through the upper story wall and flooring, to the sewer pipe 24 of the sewer system. Such plumbing arrangements are very well known, particularly to plumbers who are the persons initially installing the fixtures and the plumbing related to them. When there is water being used in the fixture 12, there is usually water trapped in the lower U-shaped part 26, so that the water level is between the highest level 28 and the lowest trappable level 30. So long as the lowest trappable level 30 is covered by water, the water provides a physical blockade between the plumbing fixture 12 and the sewer pipe or line 24. In usual usage, the actual water level is somewhere between the levels 28 and 30. In FIG. 1, the vertical difference between those two levels is shown as being a relatively short distance, and in FIG. 2 that vertical distance is a considerably longer distance.

The highest level 28 of either water or the liquid blocking device 42 is set by the weir 32 of interior pipe wall of the trap 20 where the outlet 34 of the trap is formed to make the weir 32 by a part 34 of an upside down U. Usually, that part 34 is almost an upside down L, with outlet part 34 having a high point that is the weir 32, and is only slightly higher than the piping that is, or leads to, the sewer pipe 24 to which the trap outlet 34 is connected, as shown in FIG. 1, or may have a longer upside down U shape, as is shown in FIG. 2.

The lowest level 30 is set by the high-side inner surface 36 of the bottom part 38 of the U-shaped trap part 26. So long as the water (in daily use) or the liquid blocking device 42 (when not being used for a long period of time) is in engagement with that high inner side surface 36, the water or the liquid blocking device 42 closes off any air connection between the fixture 12 and the sewer line 24. This closure prevents odors from passing through the trap to the fixture and beyond.

However, water just standing in the trap 20 for a period of time, often just a few days or weeks, depending on how much water there is in the trap lower end, may evaporate to the extent that it no longer is in touch with the high-side inner surface 36. Once this occurs, there is an air passage from the sewer line 24 and the fixture 20 through which sewer-line odors may readily pass. These odors often permeate the part of the building 10 where the fixture 12 is located, resulting in a virtually uninhabitable condition which must be removed before persons can use the interior of the building 10. When there are several fixtures in the building that have the same general arrangement, some or even all of them can eventually have the passage sources for sewer odors to enter the building. When the trap has a greater distance between the levels 28 and 30, or A and B, as shown in FIG. 2, this is somewhat less likely to occur in a relatively short time. However, when the building 10 is closed up for many weeks, or even many months, the water can eventually evaporate and admit the sewer odors into the building.

FIG. 3 is a schematic representation of the elements of the liquid blocking device 42 embodying the invention. This drawing shows those elements to be "G," identified by the reference numeral 44 and being part of a glycol family; water, identified by the reference numeral 46; and the controls 48 that are provided in a particular liquid blocking device. Such controls may include an odor eliminator or eliminators, or possibly odor maskers 50, and/or insect control(s) 52 and/or vermin control(s), which are identified by the reference numeral 54. The actual sizes of the blocking devices 42 containing the particular elements actually being used in any particular blocking device 42 do not change the ratio relationships of the relative volumes of the glycol 44 and the water 46, shown in FIG. 3. Different sizes desired, measured by volume, of the liquid blocking devices may be supplied in accordance with the plumbing traps' internal diameters and the length of the traps from between level 28 and level 30. See the chart provided later in this document for some examples. The particular control elements 50, and/or 52, and/or 54 that are to be used, depending upon the conditions that are expected to exist by the user, are mixed together with the glycol 44 and the water 46 so as to form an emulsion or other mixture. The particular mixture form characterization depends upon the characteristics of the control element or elements in relation to the glycol 44 and the water 46. Some such elements will virtually dissolve in the solution formed by the G and the water. Others will emulsify but will not dissolve. Still others may be just suspended in the G and water mixture.

FIG. 4 is a cross-section view of a P-trap 100 placed at the bottom of a floor 102 in a recess 104, showing a blocking device 106 embodying the invention in that trap. The recess has a grate 108 over it, so that persons can walk over that part of the floor. Otherwise, the trap 100 has a U shaped section 126 and functions in the same manner as does the lower half 26 of the S-shaped trap 20 shown in FIGS. 1 and 2. The lowest allowable level of water when the trap 100 regularly has water, soapy water, grease, or whatever being put into it regularly, or if the liquid blocking device 106 is installed for weeks or months while protecting the enclosure 112 from odors, obnoxious fumes, insects, vermin, or whatever, while the trap has no flow through it, is set by the high side inner surface 136 of the bottom part 138 of the U-shaped trap part 126. So long as the invention is to be used in a car wash installation during the time that is to be left idle for a longer period of time than that occurs as a regular part of the business week of, the car wash, soapy water and then the rinse water is not being used, the operator of the car wash installs a proper amount of a liquid blocking device which, according to the invention, is preferably the liquid blocking device 106. Because the recess 104 is not being used for a long period of time, the blocking device 106 is poured into the trap so that it fills the lower part of the P-trap 100, usually slightly below, but no higher than the weir 134. The liquid blocking device 106 closes off any air connection between recess 104 and the enclosure 112 and the sewer line 124. The enclosure 112 may have any of several uses. It may be a kitchen in a restaurant. It may be a part of a car wash where the soapy water and the rinse water are located as the car is being washed, and that soapy water and the rinse water will enter the U-shaped end 140 that extends through the floor 142 of the recess 104, and flows through the U shaped part 126 and out of the trap at its weir 134. That weir is the high point that is defined by the lower inner part 134 of the U-shaped P-trap 100, and therefore the part 134 and the weir share the same reference number 134.

From there, when being a part of a car wash, the car wash's soapy water and then the rinse water used to remove the remains of the soapy water from the surface of the car is piped on to the sewer pipe 124. When the restaurant or car wash for any reason is to be closed for a period of time, whether only one or two weeks, a month or six to twelve months, or if in a restaurant it is actually used just once a week, it should be protected from any odors, insects, or vermin, that are likely to have an opportunity to invade the closed business building. That is best accomplished by employing at least one major aspect of the invention, which is the combination of a glycol and the needed controls that can substantially prevent any of those threatening occurrences from happening. There is at least one originally filed claim that covers this type of usage with very little or no water being used, usually because the glycol is to also function as an anti-freeze, as noted in that at least one claim. When also using the inventive concept wherein the liquid blocking device includes the preferred amount, by volume, of water in relation to the glycol being mixed with the water, the result is that there is no substantial change in the volume of the liquid blocking device over even an period of time that the car wash or restaurant is to be unused for at least one month, and usually for several months.

FIG. 5 is a graph showing the relationship of the percentage of the volume of the entire liquid blocking device 42 or 106 that is glycol to the remaining volume of the of the entire liquid blocking device 42 or 106. It shows that, when the remaining volume of the entire liquid blocking device remains at 100%, and thus does not change while the polyethylene glycol that is 62.5% of the entire volume of the liquid blocking device 46 or 106, the evaporation rate of the water proportion 46 of the liquid blocking device results in the same volume of water being evaporated that is being absorbed from the atmosphere by the glycol 44 proportion of the liquid blocking device 42 or 106.

The percentage of water 46 relative to that of G 44 can be varied with the lowest temperatures that may be reached while the building or trailer or mobile home is unoccupied or stored, without realizing that there should be consideration of the best percentage by a person who is not aware of the importance of having the best ratio of these volume percentages so that the volume of the liquid blocking device remains substantially constant. Since it is very commonly sold with 50% G and 50% water, that percentage will almost automatically be used by the uninformed purchaser of it to protect against freezing of the traps most of the time. However, a larger percentage of G is usually used when the 50-50 mixture does not protect against very cold temperatures and many persons are aware of that, particularly if they live in any area where the temperature drops to 15 to 20 below zero. That otherwise uninformed person may then just use 100% glycol because it is usually available only in that percentage and in the 50-50 percentage. In the prior art usages, this is the only reason that appears to be likely for changing the mixture percentage to the extent that there is no water in it at all. There was found to be no recognition or concern expressed in the public art about the possible change in total volume of the entire mixture as it is within each plumbing trap, again apparently only because they have not discovered the importance of the ratios between the glycol and the water that the present inventor has discovered.

Discussion about the Liquid Blocking Device to be Installed in Such a Trap

The arrangement or device or mechanism 42 (It can be called either of those, but it is preferred that it be called a device.) embodying the invention is a combination of materials comprised of at least the major parts of liquid glycol 44 and water 46 that can be put into plumbing traps 20. When it is put into a plumbing trap of either the S-type or the P-type, its volume is sufficient to fill the U-shaped part 26 of the trap at least enough to physically block the ingress of sewer odors through it. In practice, a sufficient amount of the invented device should be able to fill the trap so that its highest level is at or near the weir 32 that lets any excess flow on toward the sewer. It can remain there until the building 10 is again occupied, and can then be flushed out into the sewer system 24.

To use the invention and more fully protect the fixtures and the building itself, each of the plumbing traps 20 in a building 10 or the like is filled with a proper quantity of liquid blocking device 42, as above prescribed. The plumbing traps 20 are connected at one end to plumbing fixtures such as a toilet main body 18 which normally can have water and other substances draining with the water into the sewer system 24 at times during or after use by someone of any of such plumbing fixtures. The drain water and other substances that are at various times put into the fixtures act in a fluid flow manner as they pass from the plumbing fixtures, such as toilet 18, through the plumbing traps 20 and beyond the traps into the sewer system 24 serving the building 10 or other structure in which those plumbing fixtures are located. Such fixtures in common usage are wash basins, bath tubs, kitchen sinks, clothes washers and tubs, bidets, toilets, showers, and the like. Some allow flow into plumbing traps 20 to the sewer system 24 as they are being used, while others are first used, and then flushed to cause such flow. In some buildings, the fixtures may include other cleaning stations as well as fixtures used to process and prepare one or more products, such as vegetables, meats, and the like, for use as food or for other desirable uses.

Discussion about Noxious Odors and Controls Thereof.

Odors are created as gases made up of odor molecules. Many odors are considered to be desirable or beneficial, among other things being found in a very large perfume industry. Others are often created by decaying organic material, such as vegetation or meat. These odors are actually created by bacteria that are part of the decaying process. Methane is a gas produced in this manner. Therefore, its molecules are one type of odor molecules. It is these odors that are often found in sewer systems and are classified as noxious odors. Odors of many types, including some noxious odors, are found in various areas—from bottles and cans to rooms in buildings. Sometimes, the odor molecules may just be masked. At other times, they may actually be absorbed so as not to be sensed, or they may be chemically changed so that they are no longer a noxious odor. In other instances, or in combination with masking or adsorption, an odor control may act to kill the bacteria that create the odor molecules that are the noxious gaseous odors, thus eliminating the odors themselves. Either of these latter actions result in the removal of undesirable odors.

Particularly noxious odors (as well as noxious insects such as, but not limited to, roaches, and noxious small animals at times) are found in sewer systems to which various plumbing fixtures, such as toilets, sinks, wash basins, clothes washers, bath tubs, and showers, are connected for the disposal of contents that are in the fixtures at times. Those contents are often themselves the producer of some such odors, and particularly those that have human waste received in them and are flushed through the plumbing fixture or fixtures in which they are contained. This can occur by the use of diapers with infants and other incontinent persons, where the diapers are often "rinsed" in a toilet bowl and the water that cleaned them; some of the diapers may be inadvertently flushed and then either go to the sewer connection or become jammed up in the toilet or the plumbing trap on their way to the sewer connection. The same concept applies by the common use of what is known as toilet tissue for the well-known purposes. Other items include the materials that are sent through a garbage grinder that is connected to the fixture and a plumbing trap. The gaseous odor molecules from such materials near the trap could pass through an open trap, and some will find a niche in which to stay for a time until conditions change, and, with liquid blocking devices in the traps, such molecules may at times engage the blocking device and the odor controls in it.

If there is some odor-producing material at or barely beyond the outlet end of the trap that connects with the sewer line, or in the sewer line itself, and the building is not occupied for extended periods of time, odors that come from any point downstream from the trap, to and beyond the sewer line, at some point in time can easily enter the building through traps that have been left with only water in them. The water will evaporate at a sufficiently fast rate to lower the level of the water in the bottom of the trap loop that is below that of the weir, which is the highest part of the trap's inner wall where it is in the shape of an inverted U, opening the trap to allow the passage of sewer odors (and sometimes to even allow insects and/or very small animals) to enter the trap and go through it into the fixture that the trap is supposed to protect. If such a small animal enters the trap and dies while either in the trap or in the fixture, or having escaped those and gone into the building and later died, then a very strong bad odor is soon created, and it can spread not only though the building, but can be adsorbed on the surfaces of the trap and the fixture, and eventually, such items as curtains, bedding, stuffed furniture, and clothing remaining in the building. This makes it even more difficult to clean the building at a later date. This possibility is a very real one, and should be considered when selecting the odor controls to be used. Various odor control products are described in more detail in the section of this specification relating to some available products for odor control. There are hundreds more of such products, but these cover the broad areas including them. Because of this, the discussion about relatively few of these products is not considered to be a limitation as to which specific commercially available odor control products are to be used when practicing the invention.

There are several known odor treatments that are used commercially to treat odors which can be odors similar to those found in sewers connected with individual plumbing traps for various types of fixtures, but are also found in waste products treatment systems operated by local governmental entities, such as cities, counties, and townships. Such a waste products treatment system typically includes networks of sewers and sewer pipes that are connected to receive the typical combination of water and solid as well as liquid waste products from households and commercial sources and deliver them to the point of treatment. There are systems that are available for meeting the demanding, yet somewhat subjective, requirements for industrial and municipal odor control applications, However, these are too expensive for buildings such as individual homes, condominium apartments, and individual units where the needs would still be on a single unit basis.

One such system is manufactured by Bio-Reaction Industries, Inc. of 9396S.W. Tualatin Sherwood Road, Thalatin, Oreg., U.S.A. It is known by its title, Bio-sumpVent™ Odor Control. It deals with various odors, not just the rotten-egg odor of hydrogen sulfide. The Bio-sumpVent™ is a modular bio-oxidation system designed to meet the demand for odor control at lift stations, sewer vents, and other contained processes that emit nuisance odors.

According to a paper on the internet web site of Bio-Reaction Industries, Inc., it uses Bio-Reaction's patented Bio-airSPHERES for the adsorption and digestion of odoriferous compounds emanating from odor causing sources which may include wastewater collection processes, lift stations, sewer gas vents, animal and food processing facilities and other odoriferous processes. The Bio-Reaction's system has an automated humidification/watering system and an induced draft fan. Optional heating systems and insulation are available for colder environments. It is a self-contained bio-oxidizer requiring an electric power supply, water, and a drain to a sanitary sewer for any minor blow-down discharges. A single stack or multi-vessel system, sized to accommodate all air flows and concentrations of mixed air stream contaminants, includes a prehumidification/ore-treatment area, followed by the Bio-airSPHERES organic media.

Treatments act to eliminate or at least minimize odors from the treatment point to an acceptable level when emanating from the waste products treatment system. One of the methods of treatment is to burn the methane gas that is the product of waste dumps sometimes known as garbage dumps. This result has been virtually demanded by the neighbors of such garbage dumps. However, it also is very different from the invention herein disclosed for use with individual plumbing traps for fixtures that are commonly found in residences of all types, as well as office buildings and similar buildings for other purposes.

There are odor eliminators on the market that claim to take care of odors by destroying the bacteria that produce the odor molecules that are usually gases which we smell and recognize as odors. Some providers claim that they absorb the odor molecules forming the odoriferous gas that we often smell and find it to be obnoxious. Others claim that they eliminate the decaying material such as vegetation and meat by chemically changing them. Some claim that they take care of odors in two or all three of these manners.

For use in practicing the invention herein disclosed, the odors are preferably either adsorbed, absorbed, chemically trapped or eliminated by destroying the source(s) of the odors, so that they cannot pass beyond the odor-masking or odor-eliminating materials used in the mixture devices that are forms of the invention. These odor-eliminating objectives may be accomplished by one odor-destroying or odor-eliminating material, and at times it is within the purview of the invention to use two or more materials that eliminate the odors in different or similar ways, so that all manner of sources for the creation of the odor molecules that become, to us, noxious odors, which just "smell bad" and at times are also deleterious to other materials that they contact, which can be treated and trapped or eliminated.

One desirable type of odor control currently on the market states that it will quickly destroy the dead animal body so that the bacteria that feed on and cause bad odors of dead bodies do not have time to continue creating bad odors, and is usable immediately adjacent to or actually within the plumbing traps for various plumbing fixtures where it would be most appropriate. However, this is not always practical. It may be better to use either an insect or vermin control, or both, which will kill the insects and/or the vermin only a short time after it is injested or has contacted the body and will shortly kill the potential intruders. Some such controls will do this within a few minutes, others may take a few hours, still others may take a few days. If at all possible, the potential intruder should be physically discouraged or prevented from forcing its way through the liquid blocking device so that it dies, but not in the fixture or a room of the building. If the control will cause immediate severe irritation to the potential invader, that is likely to be sufficient discouragement that it will not attempt to go through the liquid blocking device. The "slickiness" of the glycol will also help to have that desired result. Some controls may have boron that is ingested by an insect, and hardens over a few hours so that the insect dies. Some vermin controls have similar short-delay characteristics. That can be important because, even if the insect or vermin succeeds in forcing its way through the liquid blocking device, it dies before it has an opportunity to multiply and have numerous such intruders in any area that they are not to be permitted.

The maker and seller of SCOE 10X is BioFOG, Inc. of Alpharetta, Ga., U.S.A., claim that this product is particularly equipped to accomplish the above. Since they seem to have thoroughly analyzed the odor problems and their solution, the following information, found on the website for SCOE 10X, is provided.

BioFOG, Inc. claims that its SCOE 10X will completely eliminate the numerous objectionable odors, including skunk spray, urine from bears and dogs, spoiled fish, putrid chicken left in a hot car, cigarette smoke in homes, a dead rat in a washing machine, dog kennels, raccoon, pig, horse, cow, an animal's urine, feces and vomit odor, wheelchair pads in nursing homes, carpet cleaning, bad shoe odor, a smelly diaper pail, and even the odors in a taxidermy shop. If it can do all that, then sewer odors should be elementary. They do point out that odors are more than just "odor molecules." They state that there are three distinct components that make up biological odor. They are (1) a biological excretion or decomposition (urine, feces, vomit, sweat, skunk spray, meat, fish, cigarette smoke, etc.); (2) odor causing bacteria (bacteria that feed on the biological excretions, multiply rapidly, and produce lots and lots of odor molecules); and (3) odor molecules themselves. As seen by the inventor of the invention herein disclosed, the biological excretions and the bacteria mentioned, working together, are the source for the creation of the odor molecules that are sensed by smell by humans and many members of the animal kingdom.

Those odor molecules are what our noses actually sense, and the information is carried to our brains, which then translate that information as smell, or simply odor, pleasant or unpleasant, or extremely so. Some of these odor molecules are carried by, or created from biological excretions of one or more types, and additional odor molecules are rapidly produced by odor-causing bacteria feeding on the biological excretions. BioFOG, Inc, also takes the position that all three odor components must be eliminated so they do not exist at the same time. That act of elimination of odor molecules may be accomplished by a single odor elimination product to permanently eliminate all of the components of a complete biological odor, and BioFog, Inc. stands by their positions that SCOE 10X is that single product. If these three components are not eliminated, the odor will naturally return. Even so, it may be that it is more practical to use separate odor control components at substantially the same time to rid the area of all odor molecules.

Also, odors cannot be permanently eliminated from a distance, according to BioFOG, Inc. When using their SCOE 10X material as the odor eliminator, the odor eliminator must come in contact with the biological excretion. BioFOG, Inc,. assuredly states that "This cannot be done from a distance; even if the distance is very small. It is just physically and chemically impossible." They tell us that room sprays and aerosols, or odor absorbers do not permanently eliminate odor because they never make contact with the real source of the odor.

According to them, their product SCOE 10X first immediately captures and destroys odor molecules that are in existence when SCOE 10X is applied to the problem. Second, that it also destroys the odor-causing bacteria's food source—the biological excretion. Third, that it will eliminate the biological excretion itself, starving the bacteria causing the odor. BioFOG, Inc., says that the result is that no more odor molecules are produced, the earlier-sensed odor molecules are scattered or widely dispersed, and there comes a time where there are no more odor molecules in that area which cause noses to sense as a smell, and the odor has been effectively eradicated.

Some of the odor eliminators that are currently on the market include a Zeolite type, marketed as OdorZOut Laundry Additive Powder, by NO Stink, Inc. The Zeolite used is an "All Natural Zeolite Mineral." The marketer states that only one to two teaspoons of this power is sufficient for a clothes washer load. That amount has also been found to be sufficient for inclusion in the water part of the gycol/water mix that is the major part, by volume, of the device that is an embodiment of the invention herein disclosed, and the particular device is for a 2-inch I.D. trap. It has no odor of its own, and does not mask or perfume any clothing-type item that is washed using the Powder. The marketer also states that it is not an odor masker or coverup, but actually rids the objects of odors by trapping the odor molecules in the Zeolite so that they do not stay with the washed items, or in the instance of using it as a part of the invention herein disclosed, stops the odor molecules from passing the blocking mechanism containing the Zeolite powder.

As earlier mentioned, when someone is faced with extremely low ambient temperatures some or even most of the time, the use of 100% glycol as an antifreeze can be used. However, when that person adds one or more odor controls, and/or one or more insect controls, and/or one or more vermin controls, the broadest part of the invention, which is the use of such control(s) in a liquid blocking device, is being used. And there was no information found that one could and should use any of such controls when the liquid blocking device has no water mixed into it when the liquid blocking device is being assembled. At that time the glycol volume would be substantially the same as the entire liquid blocking device volume, but only when the supplied control has very little or even no water diluting the active ingredient(s) is there such a small percentage. In practice, most of them actually do, because their active ingredients are often diluted by adding water before they are packaged and shipped as an odor control or an insecticide or control, or in a vermin control. Even if there is not as much water as would be desired to have the absorption of water from the ambient atmosphere as would be desired for exact maintenance of the total volume of the liquid blocking device, and the ratio of the volume of glycol to the volume of such water that is a part of a control does not attain a volume of about 37.5% of the total volume of the liquid blocking devise, it will be practicing the invention, and there will be a small increase in that overall volume, but it is likely to be so slow that it will cause some of the liquid blocking device to spill over the weir. And that is more desirable than having too much water, as elsewhere explained. Only when the supplied control has very little or even no water diluting the active ingredient(s) is there such a small percentage of the absolute total volume of the liquid blocking device added by the control(s) used that their volumes can just be ignored. Thus, only then they do not substantially change the total volume of the liquid blocking device. This is even more the case when one or more of such added controls is not a liquid, or is diluted by a different liquid, such as an alcohol.

Other products that may be used as one of the materials in the blocking mechanism of the invention herein disclosed include natural and friendly bacteria that are formulated to consume bio materials such as grease, fat, oils, soaps, and detergents. This can be more important when the P-traps are used in kitchens of restaurants where it is very likely that grease, fats and oils are going to get into the trap. One such product is BioLine, by CANNON WATER TECHNOLOGY, INC., 8412 Hillgrove Street, Granite Bay, Calif. 95746 U.S.A.

Another product is CITRUS MAGIC, which is made and sold by Beaumont Products, Inc., of Kennasaw, Ga. 30144 U.S.A. It contains elements of some citrus fruits, such as certain oils of orange, lemon, grapefruit, and such that counteract the odor molecules that are the odor being removed. While this is usually used as an aerosol spray, several ounces of it in liquid form can be added to the water portion of the blocking devices, and it will at least diminish many types of odors, including those from biotic secretions. The ingredients in the spray cans of CITRUS MAGIC are not as concentrated as are the cleaning version of CITRUS MAGIC. It is sold in that concentrated form for cleaning, and does work extremely well on oils and greases as well as other materials that need to be cleaned off or out. One would probably use that concentrated form, which may have some water in it, but surely have lesser amounts than the spray version uses to eliminate odors, such as burned food, cat litters, smoking, and such often encountered in homes as well as most public places.

At times it is desirable to use more than one of the odor controls in order to take a more full advantage of the different ways that they act to eliminate an odor. For example, it can be the Zeolite Powder, the BioLine, the SCOE 10X, or CITRUS MAGIC, as well as many other odor control materials, in any desired combination. There are so many such odor control materials on the market that the inventor has not had the time to test more than a few of them. Some do give satisfactory results, while others may be usable but not preferred. The important point is that some odor control material or materials, added to the water portion of the blocking device so that it is distributed throughout the liquid that is the result of the mixtures of the desired glycol and water, are useful. Other odor control materials may actually have some of the desired water already in them. The same is true for some of the insect and vermin controls. There may be one or more odor controls assisting in the control of the odors that may otherwise pass from the sewer line through the plumbing trap and then pass into the fixture attached to it, then on into one or more areas of the building.

Whether or not there is at least one odor contr or another control added to the mixture of the desired glycol and water, the ratio of the volumes of these glycol and water ingredients are still very important to maintain substantially the same volume of that mixture for long periods of time, and that ratio has been found to be best at about 5/8 (62.5%) polyethylene glycol and 3/8 (37.5%) water by volume, as shown in the drawing FIG. 4. Of course, the ratios may vary to some extent should a different glycol, having a slightly greater or lesser affinity for water, is used. Even so, it is still preferred that the glycol's volume be in the range of about 60% to 75% of the volume of the mixture of glycol and water. This range is purposely tilted so that about 1/3 of the range of the glycol volume be less than 62.5%, while about 2/3 of the range is greater than the desired rate of 62.5%, and the water volume range would be similarly spread. Use of such ratios will still extend the time before the water component of the blocking material evaporates to such extent that the air passage in the trap opens and connects the sewer to the fixture when less that the 62.5% (for polyethylene glycol, or at least similar percentages for other glycols is used. Meanwhile, the protection provided by the invention will be extended and will still last over a period of several months. This is another advantage attained by the use of the invention herein disclosed and claimed.

The required relatively small volumes of most of the odor controls and other controls used allow their ratios relative to the glycol ratio and the water ratio to be ignored unless they already have been diluted with water, as discussed above. However, when the volume of any odor control or controls used becomes greater than about 2% or 3% of the water, but is not water itself, it should be considered, so that the actual ratio of the glycol to the water is still within, or at least quite close to, those desired boundaries set forth above when the full control of the liquid volume of the entire liquid blocking device is most desired.

It is generally known that the water mixed with liquid G at the commonly-used 50-50 volume relationship will evaporate, albeit at a slower rate than just water alone. The amount of liquid G in a 50-50 glycol-water volume relationship, even though it is hygroscopic, cannot keep up with the rate of evaporation from the water, because it does recapture water at a slower rate than the same volume of water evaporates water. The water can still evaporate to the extent that the trap is no longer physically blocking against the passage of sewer odors, unfortunately often within a shorter period of time than the building may be substantially unoccupied. When the building is at risk of sewer gas odors penetrating it, it is even more important to also use one or more odor controls, as well as combinations of two or more different types of odor controls.

The Types of materials noted earlier are described below in detail. Type I covers odor controls. The odors requiring control are those odors that are considered to be undesirable or be noxious to humans, and therefore are to be controlled in some manner or manners so that they do not enter the fixture and then the building part in which the fixture is located. Type II covers insect and vermin deterrent or repellent controls.

There are also controls of several types which are parts of the invention. Type III is Volume Control of the liquid blocking devices. Type IV relates to antifreezes which are a major part of the liquid blocking device. All of these Types are further explained below where there is a detailed description of the invention.

Type I, Odor Controls, has several sub-types. Sub-Type $I_a$ is a sub-type of odor control that acts on the odor molecules to mask, and/or eliminate, the odor molecules. Sub-Type $I_b$ is a sub-type of odor control that deactivates the odor molecules. Sub-Type $I_c$ is a sub-type of odor control that eliminates the odor molecules. Sub-Type $I_d$ is a sub-type of odor control that destroys the source of the odor molecules so that the odor is no longer created. Sub-Type $I_e$ is a sub-type of odor control that kills the bacteria that act on vegetable or meat items to produce odor molecules. Sub-Type $I_f$ is a sub-type of odor control that destroys the vegetable or meat items on which the bacteria that creates objectionable odors. Sub-Type $I_g$ is a sub-type of odor control that becomes engaged with the odor molecules and captures them so that they are no longer freely located in the atmosphere where odors are sensed.

Type III, Volume Controls, relate to the long-term maintenance of the substantially constant volume of the liquid blocking device, made up of a hygroscopic glycol, which absorbs water moisture in the ambient atmosphere, adding to the volume of the liquid blocking device, and water, which evaporates water into the ambient atmosphere, decreasing the volume of that water that is a part of the liquid blocking device.

The first inventive step in Type III, Volume Controls, was the recognition that the total volumetric amount of the liquid blocking device is important, and can become critical if it is not adequately controlled and maintained. The second inventive step in this Type III, Volume Controls, was recognition that hygroscopic glycol does not absorb water from the atmosphere at as fast a rate as water evaporates water into the atmosphere when the water is evaporating the maximum it can evaporate under the conditions that are the same conditions for the glycol, which is also acting to absorb as much water Wab as it can for the volume that it is. The third inventive step in this Type III, Volume Controls, was that when the liquid blocking device is in place in a plumbing trap, the water in the device will automatically evaporate as much water $W_{ev}$ at the fastest rate that it can under the conditions where it is subject to the same ambient atmosphere, and that the glycol will automatically absorb as much water Wab from the ambient atmosphere at the fastest rate it can under that same condition. The fourth inventive step in this Type III, Volume Controls, was that the total volume of the liquid blocking device can be substantially maintained by taking advantage of the lesser hygroscopic nature of glycol (including at least certain glycols that have a very similar absorption rate) and the greater tendency to be evaporated on the part of the water that is mixed with it.

As a result, it was found that it takes a smaller water volume to have evaporated a certain amount of water $W_{ev}$ and the larger glycol volume will have absorbed the same amount of water over an extended period of time, anywhere from two or three weeks to a month or more, such as eight months or so, while the hygroscopic action of a greater volumetric amount of the liquid blocking device is required to absorb the volume amount from the ambient atmosphere that is volumetrically equal to the amount of water Wev. For all practical purposes, in the experiments with different ratios of glycol and water, it appears that, as the actual molecules of water (Wev) being evaporated from the water portion, it is becomes water absorbed by the glycol portion as (Wab), yet, since it is still water all of the time, because it is effectively a part of the water portion all of the time insofar as the volume of all of the water that is a part of the liquid blocking device, and the actual amount of water in the liquid blocking device has not really changed. This cannot occur when there is insufficient glycol in the device to subsantially counteract the evaporative removal of water Wev by its absorption of the water Wab. The net result would then be a net evaporative loss to the ambient atmospheric air of a certain volume of water (Wev less the missing amount of the smaller amount Wab) from the liquid blocking device (per a certain unit of time). At some point in time, there will then be insufficient volume of the liquid blocking device to keep the top part of the bottom of the upright U part of the trap closed with the liquid blocking device, opening an air path between the sewer system and the fixture with which the plumbing trap is associated. That point in time may occur within the period of time that the building is closed and no fixtures are used. That is a result that should not be allowed to occur.

On the other hand, there may be so much glycol in the liquid blocking device that it absorbs more water Wab from the ambient atmosphere than the lessor amount Wev of the water is able to evaporate, with the result that the total net volume of the liquid blocking device will continually increase to the volume extent that some of the liquid blocking device can eventually pour over the plumbing trap weir leading to the sewer system, depleting the volume of the liquid blocking device until the device no longer is pouring over that weir. If that cycle should be repeated long enough and sufficiently often, it would very slowly decrease the amount of the glycol relative to the amount of water in the liquid blocking device, until the balance between the volumes of the glycol and the water would at least approach the relative amounts by which the volume of the liquid blocking devise has that maintains the liquid blocking device. However, that would probably take more time than the owner or operator of the building would leave it unoccupied, and in the meantime would be decreasing any amount of materials that have been put into the water initially as an emulsion, with such materials being chosen from odor controls, and other controls set forth above, being deleted each time there was some of the liquid blocking device poured over the weir, and it would lose some effect because it has also been depleted. This leads to the conclusion that it is best for one to start out with the balanced amounts of glycol and water so that that balance is maintained as long as the liquid blocking device is in place, or to err slightly on the side of having a little more glycol than is ideal for replacing the evaporated water lost from the water that is a part of the liquid blocking device.

With that conclusion, then it becomes very desirable, at the beginning, to maintain the total volume of the liquid blocking device at or near a constant volumetric value, which can be established as being reasonable when the liquid blocking device is expected to be in place in a plumbing trap and fully functional for extended periods measured in weeks, and going into several months. That cannot occur with a 50% each of glycol and water, because that amount of glycol will absorb less water over a given time than the water will have evaporated. This is only made worse when there is less glycol than the amount of water, by volume in the liquid blocking device. As stated in describing FIG. 4 of the drawing, there is an optimum value of the amount of the glycol's removal of water from the atmosphere which is a match for the amount of water that is evaporated from the atmosphere. This just requires that there be a glycol, preferably but not necessarily polypropylene glycol, that is about 62.5% of the total volume of the liquid holding device, and 37.5% water from which some water is being removed to the ambient atmosphere. "About" is said because some glycols that can be used other than polypropylene glycol may require to be slightly more or less than the 62.5%, because they might have slightly more or less hygroscopic capability than does polypropylene glycol.

There is no specific number of weeks or months set that the liquid blocking device is to remain fully functional, but because they are expected to be used by many homeowners who have two or more residences, such as is common when one lives in a high-latitude climate during the summer and in a low-latitude climate in the winter months, leaving one of those residences unoccupied for several consecutive months, it is desirable to be away at least three months, and preferably even six or more months. As an example of this type of arrangement, persons may have a main, or warm-weather, residence in the United States of America in more northern states, such as those above the 40th parallel, as well as in several of the states somewhat south of that parallel of latitude. When they leave their northern states in the late fall, they winterize their northern homes so that there is no likelihood of freezing damage to their homes, and particularly their plumbing. They must anticipate winter temperatures that range anywhere from about −40° F. to the freezing temperature of 32° F., with some slightly warmer days. This preparation includes the draining of their water plumbing, and often they then put ordinary antifreeze of the type that is used in automobiles and truchs, in the plumbing traps. Then, when they leave their more southern winter homes they do a similar home protection, realizing that, even in these semi-tropical states, there are times when the temperature falls below 32° F. In addition, particularly in the southern parts of this country, there are various insects and small animals, such as mice and rats, that can have access to sewer systems and will try to gain access to the interior of a home or other building. Also, sewers everywhere have objectionable odors, and no one wants to have such odors enter their homes or offices when no one is there for extended periods. Those extended periods vary anywhere from two, three or four weeks to as long as about six, seven, or even, for some, as much as eight months. So there is a definite need for this invention in all of the United States of America, and similar needs throughout the world, and this invention is expected to remain operable for such periods of time.

Since one of the objects of the invention is to keep the total volume of the blocking combination of materials substantially constant for a desired multi-month extent of time, and when that objective is sufficiently important to be included in a blocking device, it is accomplished by keeping the relative percentages of the antifreeze material (which is a hygroscopic material) and the water is controlled by balancing the evaporation rate of the water into the ambient air environment and the hygroscopic absorption of the water moisture from the ambient air environment so that the net effect of the actual total volume of the blocking device, which both absorbs water moisture and evaporates water as moisture, at rates that remain substantially constant over a long period of time. Since the water moisture being absorbed by the hygroscopic glycol is usually at a somewhat slower rate than the rate of evaporation of the water component when both components are exposed to the same ambient environment, it follows that there needs to be a somewhat greater volume of the hygroscopic glycol component than the volume of the water component so that the total volume of the two components remains satisfactorily constant. As discussed above in more detail, and as shown in FIG. 4, that ratio of volumes is best at about 5/8 (62.5%) glycol and 3/8 (37.5%) water. A ratio within a reasonable range can usually be satisfactory, as also later described. While it is tempting to place the range limits so that the ideal mix is in its center, and that can be done and still be within the purview of the invention, it is better to have the lower limit of the percentage of the glycol to be closer to the ideal 62.5% and the upper limit of the percentage to be further away and greater than that ideal 62.5%. Such a range could be about 60% at the lower limit of the percentage of glycol relative to the water, and about 70% to 75% at the upper limit of the relative volume of the glycol to the water. Thus, if there is any deviation from the desired percentage of glycol, it is more likely to just cause a little, but very little, increase in the total volume of the glycol over a period of many weeks or some months. As the analysis elsewhere herein shows, that would not be as bad as it would be if the glycol percentage were to be well below the desired 62.5% of the total volume of the liquid blocking device.

Additionally, there is herein disclosed and claimed an inventive method of controlling the actual volume of the liquid blocking device so that it remains substantially constant over the long periods of time in which the building is unoccupied and the fixtures are not used. This is important because at least one of the materials most likely to be used is water, and it is either a major component, or at least a very substantial part, of the blocking device by volume. Water is an evaporative material, and by evaporation such material can lose sufficient volume to the ambient atmosphere to the extent that, given time, the volume of the entire blocking device would be decreased until it no longer blocks the trap, and one or more obnoxious invasive matters can enter the trap from the sewer line to which it is connected, and ultimately enter the building, with deleterious results. However, another one of the desired liquid materials, making up virtually all of the volume of the blocking device that is not water, is a hygroscopic glycol which absorbs moisture from the ambient atmosphere. The water portion of the liquid blocking device loses moisture to the ambient atmosphere while it is exposed to that atmosphere, but not at the same rate as occurs if an equal volume amount of the hygroscopic material absorbs the moisture. That absorption rate of the glycol is less than the evaporative rate of the water. The method, with various added steps when there are other controls added to the liquid blocking device, is set forth below:

1. The method of keeping the total volume of a liquid blocking device for a plumbing trap substantially constant over an extended period of several weeks to several months, said method including the steps of:

(A) determining the rate of evaporation of the water that forms a part of a liquid blocking device;

(B) determining the rate of absorption of water moisture from the ambient atmosphere by a hygroscopic liquid that also forms a part of the liquid blocking device;

(C) Determining the volumetric amount of one of the liquids of the liquid blocking device that is required to make the volumetric amount of water that it either has absorbed or has evaporated be equal to the volumetric amount of water that the other liquid of the liquid blocking device that it either has evaporated or absorbed;

(D) establishing the volumetric ratio of one of the liquids of the liquid blocking device relative to the other of the liquids of the liquid blocking device; and (E) mixing the two liquids in accordance with that established volumetric ratio to create substantially all of the volume of the entire liquid blocking device for the use of that liquid blocking device to block the passage of a plumbing trap.

2. Each of the numbered 3 through 8 items below are similar to dependent steps or parts of steps of the method 1 set forth in the paragraph immediately above:

3. Before performing step (B) of the above method, establish the hygroscopic liquid as a liquid antifreeze.

4. Before performing step (B) of the above method, establish the hygroscopic liquid as a liquid glycol.

5. Mix at least one noxious odor control with the water of step (A), so as to make the resulting liquid blocking device, when installed in the plumbing trap, able to at least decrease the presence of one or more noxious odors before such odor or odors can pass through the plumbing trap from a sewer that is connected to the discharge end of the plumbing trap. Of course, the recitation of "at least one" of any element being claimed covers the fact that there may be two, or three, or whatever quantity of those elements are to be put into the liquid mixture that will be the liquid blocking device. It does not limit the use to only one, but does include the possibility that use of just one of the named elements is within the coverage of any claim of invention having that phrase, and is still the same invention. This applies to any recitation of "at least one" herein, not just the one that is contained in this paragraph.

6. Mix at least one insect control with the water of step (A), so as to have the resulting liquid blocking device being able to at least decrease or discourage the presence of one or more insects going through the plumbing trap by action of the at least one insect control before one or more of such insects can pass through the plumbing trap from a sewer that is connected to the discharge end of the plumbing trap.

7. Mix at least one vermin control with the water of step (A), so as to have the resulting liquid blocking device being able to at least decrease or discourage the presence of one or more vermin by action of the at least one vermin control before one or more of such vermin can pass through the plumbing trap from a sewer that is connected to the discharge end of the plumbing trap.

8. Before performing step (A), determine the amount of water that is in any controls to be added, and reduce the amount of added water accordingly, or even completely when there is a sufficient amount of water already in the control or controls to be added.

When using the respective rates of absorption and evaporation of the glycol and the water, and therefore the relative volumes of the glycol and the water that are mixed together, the two opposite actions of absorption and evaporation cancel each other out. The temperature of the ambient atmosphere normally experienced is not a consideration, so long as both the glycol and the water remain liquid, because any changes in it will equally effect both rates. Each one will still either evaporate or absorb the same amounts of water as does the other so long as they still have the same volumetric proportions relative to each other.

The inventor has found that it is quite important to consider the rate of evaporation of the water from the water portion of the mixture as well as the hydrophobic characteristic of G wherein the rate at which G absorbs water into the glycol portion of the mixture. More particularly, he has found it to be very desirable that the actual volumetric amount of water evaporated from the water portion of the liquid blocking device and the actual volumetric amount of water absorption by the glycol portion of the liquid blocking device be the same, or quite close to the same, over any period of time, under conditions that the particular use of the mixture of G and water is expected to be used. This can be substantially controlled by the percentage of the total mixture that is G, and the remaining percentage that is water and the relatively very small amount, by volume, of the odor controlling material. The relatively small volume of the odor and/or insect or vermin controlling material can be safely ignored for this particular purpose because, being relatively small and usually is not either evaporated or absorbed, it causes very little change in volume of the water or the glycol when it is added into the water and is then mixed into the glycol so that is actually mixed into both. The balanced gain of water by volume due to the absorption of water and the loss by volume of water due to the evaporation of water, becomes quite important in the particular usage to which this invention is applied. One might consider that in theory the volumetric amounts of the water evaporated and absorbed is a separate part of the liquid blocking device. However, because they are equal and opposite in volume, that theoretical separate part of the liquid blocking device has a volume of zero.

The rate of evaporation of water at different ambient temperatures and relative humidity varies to some extent. Water evaporates at a high rate in arid locations, such as the U.S. state of Arizona, because the ambient high temperature often reaches over 110° F. and the humidity may be less than 10%. In south Florida, for example, it is common to have relative humidity in the range of 60% to 100%, but temperatures that very seldom reach 100° F. Also, during the summer months, as well as most of the spring and fall times, the temperatures (in ° F.) are usually between the low 70s or high 60s at late night, and only in the high 80s to middle or upper 90s about 3:00 p.m., with the occasional higher daytime temperatures or lower nighttime temperatures. Both of these areas are typical examples where many homeowners have residences there which are seasonally occupied during the winter months, and during the remainder of a year the residence may be closed, possibly with the water being shut off, and may or may not have at least weekly inspections to see that all is well with the house, inside and out.

In other areas, such as Vermont, for example, a residence may be closed in the winter for several months while the owners are enjoying a more tropical area with much milder temperatures, and may or may not even have listed it for sale. Then, the owner must also be primarily concerned with freezing temperatures that can damage plumbing if the house is not being heated, or if the heat that is programmed fails to operate. Then, the protection against having the plumbing traps freeze, and the protection against evaporation of water in such traps, is supplied when using the invention. The odor controls and other controls such as for insects and vermin are still advisable in such winter climates, but are not as much needed as tis antifreeze protection, unless the owner just drains all of the potable water from the building's water system. Then, the plumbing traps would likely be open to sewer odors, and the invasion of insects and vermin, such as rats and mice, would be of definite concern, unless the owners make use of the invention herein disclosed and claimed. The invention can serve against freezing and can provide the blockage of insects and vermin excellently, even when the household potable water has been drained from the water system of the building.

It has been found that, in such different conditions, various mixtures of G and water become more important than currently being considered by the transitory population, so that the total mixture net volume remains about the same over a period of weeks, or even many months. Under those conditions, when the mixture is predominately G, say above 75%, and thus only 25% water, the net volume of the mixture tends to noticeably increase over time because the net volume of the water content increases. When the mixture has the reverse percentages of 25% G and 75% water, the volume of the mixture tends to noticeably decrease over time because the net content of the water content decreases. It has also been found that the best ratio is about 5/8 (62.5%) PG or G, and 3/8 (37.5%) water, with slight variations depending on the particular specific liquid glycol that is being used, and they may have some slightly different water absorption rates from the rate of polyethylene glycol, on which the use of 5/8 glycol and 3/8 of water to produce the desired liquid blocking device is based, so that the volume of the mixture remains substantially constant because the amount of evaporation of the water, by volume, and the amount of water absorption by the PG or G, are substantially the same, so that they offset each other. Because the addition of odor and/or vermin controlling material is a very small percentage by volume, usually being about 1/10 as much by volume of the water when using any one of the several available odor controlling materials, and even less when the odor controlling material is in a powder form, would result in a water and odor control mixture volume to be increased from 3/8 to 3/8+3/80 ratio, and the G volume of the mixture of G, water, and the odor controlling material in it would still be very close to 62.5%-0.375%, or 62.125%. Or, since 3/8 is 37.5%, and 3/80 is 0.375%, the water and odor-control-mixture volume at or very near the amount where the total volume remains substantially constant would be only 37.875%, and the remaining volume of the mixture, the G, would be 62.125%. This means that the volume of the typical odor controlling material would have very minimal effect on the point where the evaporation of the water component and the absorbent of water by the G component are offsetting, the volume change would be minimal and need not be considered. Thus, for simplicity, one can conclude that about 62.5% of the total mixture be G, and about 37.5% be the mixture of water and the odor controlling material. This will keep the total mixture volume substantially the same for extremely long periods, such as even measured in months volume that may become a year or more.

Therefore, it is an important aspect of this invention that the best ratio of G to water is about 5/8 to 3/8, or 62.5% G to 37.5% water with the odor controlling material already mixed into the water if the owners or managers of the buildings want to be sure that the building plumbing is protected during freezing weather. However, while preciseness is always desirable, it can at times be overly demanding. Accordingly, it has been found that an acceptable range of this mixture would be at least a variation of these two major amounts by as much as about 7.5% more change in either direction. Thus, an acceptable range, given in whole percentages, could be that the G have a percentage by the volume of the final mixture to be between about 55% to 70%, and an acceptable range of the water with the odor controlling material volume to be about 45% to 30%. When these ranges are exceeded, the net change in volume of the entire mixture over a period of even a few months becomes more undesirable, because such changes in volume will result eventually to either too much volume being lost by evaporation or too much volume being lost by having the excess flow out of the trap over the weir because the blocking suffers a loss in volume when any flow over the weir and goes on into the sewer system. The result is that the volume of the total mixture in the trap is decreasing as time goes by, and the volume of the blocking device no longer remains within the required level limits. It shortens the time before the volume loss of the total mixture results in the level of the mixture in the trap becoming sufficiently low to open the trap at the bottom of the inverted U portion, and the physical blockage of the mixture of G and water has been eliminated. If the expansion of the glycol volume due to the addition of water because the glycol does adsorb water vapor is of no concern, then the ratio of glycol can be increased. Likewise, if the contraction of the volume is also of no concern, the water ratio of volume may be further increased beyond those desired ratio limits. These concerns can be lessened when the plumbing trap has a longer effective length than usual, so that there is a substantially greater volume of the mixture to start with. One still needs to consider the freezing point of the mixture if the use is in any area where the temperature goes below the freezing point of the mixture in use.

A good way to create this desired mixture when there is any reluctance about the mixing of the odor-controlling material into water, is to first mix the water and the odor and/or any other controlling material, and then mix that with the G. Of course, when the controlling material is quickly and easily dissolved into the water, or when it is a liquid that easily mixes with the water so as to create a dissolved or emulsified liquid combination, whitch is, in turn, very easily mixed with the G. The final mixture can also be created in an equally good way by simply doing all of that mixing in a single step instead of in two steps. While mixing it by hand may be sufficient, it is better, when preparing the mixture for commercial distribution, to use a commercial type mixer or blender that will provide a more consistent mixture of the G, the water, and the controlling material. Such mixers are available from several suppliers. When using relatively small amounts for testing purposes, a kitchen type mixer or blender will be able to do the mixing, and its result will be a better mixture than just stirring the materials by hand after they are poured into a container.

The invention may be marketed by providing the complete mixture of the various elements in a ready-to-use container, with the volume of the mixture being variable, and thus in separate containers, because the amount of the complete mixture to be used will vary with the effective length and internal diameter of the trap that is between the minimum and the maximum levels that the mixture must and can have. Since traps are available in several different internal diameter sizes, there can be a very substantial variation in the volume of mixture needed, depending on whether the trap has a 1 inch, 2 inch, 2½ inch or 4 inch internal diameter. If the effective length of a trap between the minimum level required and the maximum level that can be attained is 15 inches, then the approximate volume per linear inch length, and the suggested volume with a linear 15-inch length of the supplied mixture for that size of the pipe forming the trap are:

| BAG# | Pipe I.D. | Volume/ inch | Volume in 15" | The suggested Supply Volume for 15" long pipe |
|---|---|---|---|---|
| 1 | 1 inch | 0.7854 $in^3$ | 11.78 $in^3$ | 12 $in^3$ |
| 2 | 2 inches | 3.14 $in^3$ | 47.12 $in^3$ | 47 $in^3$ |
| 2.5 | 2.5 inches | 6.136 $in^3$ | 92.04 $in^3$ | 92 $in^3$ |
| 4 | 4 inches | 12.566 $in^3$ | 198.44 in3 | 198 $in^3$ |

A table showing the approximate needed supply volume can be constructed for each pipe I.D. and each likely effective length of the trap between the minimum level required and the maximum level that can be attained. Some plumbing traps may have a short difference between the two levels, and others may have a greater difference between the two levels. Since that suggested supply volume is very near the maximum volume that it is to occupy, there is no problem in supplying slightly less, the greatest less amount being only 0.44 $in^3$, which is less than 1/400 of one $in^3$ than the maximum volume where it goes. The only information that the purchaser needs to know is the internal diameters of his traps and their approximate effective length, and he buys the bags by the bag#, taken from the internal diameters of his various traps. The contents of the bag are poured into the plumbing fixture and goes directly into the plumbing trap, which may be integral with the plumbing fixture, or separate but connected to it to receive water and other liquids and solids deposited or poured into it.

What is claimed is:

1. A liquid blocking device for a plumbing trap that comprises a liquid glycol initially having a first volume which is a percentage of the total volume of said device and liquid water having a second volume which is a percentage of the total volume of said device, said glycol and said water being mixed together to provide an emulsion or similar combination thereof with said first and second volumes being combined to form substantially all of said total liquid volume of said device;

said glycol being hygroscopic and said water being subject to evaporation so that when said device is exposed to the ambient atmosphere said glycol absorbs water from the ambient atmosphere at a first rate and said water evaporates water into the ambient atmosphere at a second rate;

said first and second volumes each having a set percentage by volume of said total liquid volume that respectively removes water from the ambient atmosphere at a first volume rate and evaporates water to the ambient atmosphere at a second volume rate with the actual volumes of water being evaporated and being absorbed are substantially equal whereby the total volume of said liquid blocking device remains substantially constant.

2. The liquid blocking device of claim 1 in which the liquid having the slower of said two volume rates has the larger liquid volume and that larger liquid volume being within a range of about 60% to 75% of said total volume of said liquid blocking device and said liquid having the faster of said two volume rates being the smaller liquid volume of said total liquid volume of said device that is within a range of about 40% to 25% of said total volume of said liquid blocking device.

3. The liquid blocking device of claim 1 in which said larger volume is about 62.5% of said total volume of said liquid blocking device, and said smaller volume is about 37.5% of said total volume of said liquid blocking device.

4. The liquid blocking device of claim 1 in which said liquid blocking device contains at least one odor control, said at least one odor control being mixed in said liquid blocking device, and said at least one odor control being selected from a group of odor controls comprising an odor masker, an odor eliminator, an odor molecule absorber, an odor molecule trapper, and an odor source destroyer.

5. The liquid blocking device of claim 1 in which said liquid blocking device contains at least one insect control, said at least one insect control being mixed in said liquid blocking device, said at least one insect control being selected from a group of insect controls comprising an insect repellant that repels insects, an insect attractant that attracts insects and is also an insect killer, and an insect control that captures insects and renders them unable to enter said blocking device.

6. The liquid blocking device of claim 1 in which said liquid blocking device contains at least one vermin control, said at least one vermin control being mixed in said liquid blocking device, said at least one vermin control being selected from a group of vermin controls comprising a vermin repellant that repels vermin, a vermin attractant that attracts vermin and is also a vermin killer, and a vermin control that captures vermin and renders them unable to enter said blocking device.

7. The liquid blocking device of claim 1 in which said liquid blocking device is installed in a plumbing trap that receives fluid and solid matters from a fixture in a building and is connected to a sewer to which it allows said fluid and solid matters to pass until said liquid blocking device is installed in said plumbing trap, said building being subject to closure for periods of several weeks to as much as six to eight months, said liquid blocking device, by virtue of keeping its total volume substantially constant, remains in blocking relation in said plumbing trap for at least that period of time and continues to block said plumbing trap so as to prevent the entry of noxious odors and other unwelcome entities from the sewer system to which it is operatively connected.

8. A fluid blocking device for maintaining plumbing traps closed against passage of odors from a sewer system and into a plumbing fixture through such plumbing traps by keeping the volume of said fluid blocking device at a constant value over an extended period of time usually measured in months which total to as much as at least one-half of a year, said fluid blocking device comprising:

a first liquid member and a second liquid member, said first liquid member being hygroscopic so as to absorb moisture from the ambient atmosphere at a first rate;

said second liquid member being water that is subject to evaporation to place moisture into the ambient atmosphere at a second rate;

said first and second liquid members being mixed together to provide a stable emulsion that is said fluid blocking device;

said fluid blocking device initially having a set volume, all of which is at least substantially comprised of the volumes of said first and second fluid liquid members, said set volume being retained as a substantially constant volume over a period of at least several weeks while being located in a plumbing trap and is subject to said absorption and said evaporation of water moisture from and to the ambient atmosphere;

said volume of each of said fluid liquid members being such that the liquid volumetric amount of moisture evaporated from said second liquid member is substantially the same as the liquid volumetric amount of moisture being concurrently absorbed by said first fluid liquid member, and thus maintaining said fluid blocking device substantially at said set volume for a range of time that extends for one month and as much as about six to eight months without requiring replenishment of one or the other or both of said fluid liquid members.

9. The fluid blocking device of claim 8, said first blocking liquid is a liquid glycol, and said second blocking liquid is water.

10. The fluid blocking device of claim 8, said first liquid member more particularly being a glycol selected from the glycol family comprised of propylene glycol (PG), polyethylene glycol (PEG), polypropylene glycol (PPG) and ethylene glycol (EG).

11. The fluid blocking device of claim 10, wherein said first liquid member is polypropylene glycol (PPG).

12. The liquid blocking device of claim 8 in which said larger volume is within a range of about 60% to 75% of said total volume of said liquid blocking device, and said smaller volume is within a range of about 40% to 25% of said total volume of said liquid blocking device.

13. The liquid blocking device of claim 8 in which said larger volume is about 62.5% of said total volume of said liquid blocking device, and said smaller volume is about 37.5% of said total volume of said liquid blocking device.

14. The liquid blocking device of claim 8 in which said liquid blocking device contains at least one odor control substance, said at least one odor control substance being mixed into at least said second liquid member of said blocking device, said at least one odor control being selected from a group of odor control substances comprising an odor masker, an odor adsorber, an odor absorber, a chemical molecule trapper, an odor source destroyer, a killer of bacteria that creates odors, an odor oxidizer, and an odor eliminator.

15. The liquid blocking device of claim 8 in which said liquid blocking device contains a plurality of odor control substances, said odor control substances being mixed into at least said second liquid member of said blocking device, said odor control substances being selected from the group of odor control substances comprising an odor masker, an odor adsorber, and odor absorber, a chemical molecule trapper, an odor source destroyer, a killer of bacteria that create odors, an odor oxidizer, and an odor eliminator.

16. The liquid blocking device of claim 8 in which said liquid blocking device contains at least one insect control, said at least one insect control being mixed in said liquid blocking device, said at least one insect control being selected from a group of insect controls comprising an insect repellant that repels insects, and an insect attractant that attracts insects and is also an insect killer, and an insect control that captures insects and renders them unable to enter said blocking device.

17. The liquid blocking device of claim 8 in which said liquid blocking device contains at least one vermin control, said at least one vermin control being mixed in said liquid blocking device, said at least one vermin control being selected from a group of vermin controls comprising a vermin repellant that repels vermin, a vermin attractant that attracts vermin and is also a vermin killer, and a vermin control that captures vermin and renders them unable to enter said blocking device.

18. The liquid blocking device of claim 8 in which said liquid blocking device an antifreeze material which protects said liquid blocking device and any water that is in said plumbing trap from freezing down to a desired freezing temperature of said blocking device.

19. The liquid blocking device of claim 8 in which said liquid blocking device is installed in a plumbing trap that receives fluid and solid matters from a fixture in a building and is connected to a sewer to which it allows said fluid and solid matters to pass until said liquid blocking device is installed in said plumbing trap, said building being subject to closure for periods of several weeks to as much as six to eight months, said liquid blocking device, by virtue of keeping its total volume substantially constant, remains in blocking relation in said plumbing trap for at least that period of time and continues to block said plumbing trap so as to prevent the entry of noxious odors and other unwelcome entities from the sewer system to which it is operatively connected.

20. A liquid blocking device adapted to prevent objectionable sewer gases and other objectionable matter from moving backwardly through a plumbing pipe trap having one end operatively connected to a drain from a plumbing fixture and its other end operatively connected to a sewer pipe that transports fluids and materials away from said plumbing fixture and said plumbing pipe trap, each of such devices comprising:

a mixture of liquid glycol and water, said liquid glycol being a part of a family of glycols comprising propylene glycol (PG), polyethylene glycol (PEG), polypropylene glycol (PPG) and ethylene glycol (EG) that mix very well with water;

and at least one material having been mixed at least into said water to form at least a mixture of said at least one material and said water, and thereafter being a part of an integrated mixture of liquid glycol and water and said at least one material, said at least one material substantially resisting said objectionable sewer gases and at least some of said other objectionable matter from moving beyond said mixture of liquid glycol and water and then into the plumbing fixture;

said integrated mixture, when poured into a drain-connecting pipe trap, thereafter having at least a portion of said pipe trap filled at least sufficiently to prevent an air connection being created in said drain-connecting pipe trap between said ends of said pipe trap while one of said pipe trap ends is connected with a sewer pipe, said integrated mixture also acting to slow down or even prevent the loss of water out of said mixture due to evaporation and to absorb the volumetric equivalent of any water being lost because of said evaporation, therefore allowing the continued prevention of objectionable sewer gases and other objectionable matter from backing up into the plumbing fixture;

that plumbing fixture typically being any one or more of a basin, bathtub, shower, sink, wash tub, toilet, bidet, garbage grinder and the like by keeping the volume of said entire integrated mixture substantially constant for a continuous period exceeding one month.

21. The device of claim 20 wherein said at least one material is at least an odor control material.

22. The device of claim 20 wherein said at least one material is at least an odor control material and an insect control material.

23. The device of claim 20 wherein said at least one material is at least an odor control material and a vermin control material.

24. The device of claim 20 in which said drain pipe trap is connected to normally allow liquid matter and solids in said liquid matter to be drained into a sewer pipe for disposal, there being a sufficient quantity of said device to be installed into a pipe trap formed as a part of a drain pipe so that said device remains in said pipe trap and blocks at least a part of said pipe trap during periods of time of at least one month when there is no drainage through the pipe trap into the sewer pipe so long as no one tries to cause a liquid added to a fixture to flush said device out of said pipe trap and into said sewer pipe.

25. The method of keeping the total volume of a liquid blocking device for a plumbing trap substantially constant over an extended period of several weeks to several months, the liquid plumbing device being made up of at least two different liquids that are substantial parts of the liquid blocking device, said method including the steps of:

(A) determining the rate of evaporation of water from one of the liquids that is to be a substantial part of the liquid blocking device;

(B) determining the rate of moisture absorption from the ambient atmosphere by a hygroscopic liquid that is to be a substantial part of the liquid blocking device;

(C) Determining the volumetric amount of one of the liquids of the liquid blocking device that is required to make the volumetric amount of water that it either has absorbed or has evaporated be equal to the volumetric amount of water that the other liquid of the liquid blocking device that it either has evaporated or absorbed;

(D) establishing the volumetric ratio of one of the liquids of the liquid blocking device relative to the other of the liquids of the liquid blocking device to at least substantially accomplish such a set ratio; and (E) mixing the two liquids in accordance with that established volumetric ratio to create substantially all of the volume of the entire liquid blocking device for the use of that liquid blocking device to block the passage in a plumbing trap.

26. In the method of claim 25, before adding any additional water to the liquids that will become the liquid blocking device, determining the volumetric amount of water, if any, in any controls to be added and volumetrically decrease the amount of water being mixed in step (E) even to the extent that no additional water is needed as a substantial part of one of the liquids when sufficient water is to be provided to establish said ratio of water volume to the total volume of the liquid blocking device by such control or controls or other control or controls to be added.

27. In the method of claim 25, after step (A) and before step (B), insert the intermediate step (B.1) establishing the hygroscopic liquid as a liquid glycol and the other substantial part of the liquid blocking device to be water.

28. In the method of claim 25, after step (E), insert the next step: (F) mix at least one noxious odor control with the water of step (A), so as to have the resulting liquid blocking device being able to at least decrease the presence of one or more noxious odors before such odor or odors can pass through the plumbing trap from a sewer that is connected to the discharge end of the plumbing trap.

29. In the method of claim 25, after step (E), insert the following step: (F) mix at least one insect control with the water of step (A), so as to have the resulting liquid blocking device being able to at least decrease or discourage the presence of one or more insects by action of the at least one insect control before one or more of such insects can pass through the plumbing trap from a sewer that is connected to the discharge end of the plumbing trap.

30. In the method of claim 25, after step (E), insert the following step: (F) mix at least one vermin control with the water of step (A), so as to have the resulting liquid blocking device being able to at least decrease or discourage the presence of one or more vermin by action of the at least one vermin control before one or more of such vermin can pass through the plumbing trap from a sewer that is connected to the discharge end of the plumbing trap.

31. A liquid blocking device for substantially blocking one or more objectionable materials from a sewer pipe from entering a fixture having a plumbing trap connected to the sewer pipe, said liquid blocking device including at least predominantly a glycol which is also an antifreeze liquid that is particularly, but not always, used when the low ambient temperature often reached requires that the liquid blocking device be at least predominantly antifreeze, and at least one control item that is a control for substantially preventing at least one of the objectionable materials in the sewer pipe from entering the fixture through the plumbing trap, said objectionable materials being comprised of noxious odors, insects, and vermin.

32. The invention defined by claim 31 in which there is at least one odor control that controls noxious odors at least to the extent that such odors are substantially prevented from passing through the plumbing trap when said liquid blocking device is installed in the plumbing trap.

33. The invention defined by claim 31 in which there is at least one insect control wherein insects are controlled to the extent that insects are at least substantially prevented from passing through a plumbing trap when said liquid blocking device is installed in a plumbing trap, said insects comprising, at least, ants, beetles, roaches, mosquitoes and bugs.

34. The invention defined by claim 31 in which there is at least one vermin control wherein said vermin are being controlled to the extent that vermin are at least substantially prevented from passing through a plumbing trap when said liquid blocking device is installed in the plumbing trap, said vermin comprising at least one or more of a group of vermin including rats, mice, and reptilians.

35. The invention defined by claim 31 in which at least one of said at least one control item having been previously diluted by water, the volumetric quantity of such water being sufficient to be involved in the practice of any aspect of the invention where there is water as a separate component of said liquid blocking device, such water substituting for at least a portion of the water that is a separate component.

* * * * *